US005338496A

United States Patent [19]

Talbot et al.

[11] Patent Number: 5,338,496

[45] Date of Patent: Aug. 16, 1994

[54] PLATE TYPE PRESSURE-REDUCTING DESUPERHEATER

[75] Inventors: Arthur J. Talbot, Marblehead, Mass.; John M. Cowley, Conyers, Ga.

[73] Assignee: Atwood & Morrill Co., Inc., Salem, Mass.

[21] Appl. No.: 51,163

[22] Filed: Apr. 22, 1993

[51] Int. Cl.[5] ..... B01F 3/04

[52] U.S. Cl. ..... 261/78.2; 261/DIG. 13; 261/118

[58] Field of Search ..... 261/118, 78.2, DIG. 13

[56] References Cited

U.S. PATENT DOCUMENTS

| | | | |
|---|---|---|---|
| 1,245,985 | 11/1917 | Saunders . | |
| 1,564,052 | 12/1925 | Ehrhart | 261/118 |
| 1,773,053 | 8/1930 | McDermet . | |
| 2,155,986 | 6/1937 | Wheaton | 261/116 |
| 2,328,414 | 8/1943 | Beyer | 122/31 |
| 2,725,221 | 12/1952 | Pontow | 261/62 |
| 2,797,904 | 7/1957 | Voorheis | 261/118 |
| 3,217,488 | 11/1965 | Von Ohain et al. | 261/118 |
| 3,220,708 | 11/1965 | Matsui | 261/39 |
| 3,287,001 | 11/1966 | Harris | 261/78 |
| 3,318,589 | 5/1967 | Herp, Jr. | 261/160 |
| 3,524,630 | 7/1968 | Marion | 261/76 |
| 3,719,524 | 3/1973 | Ripley et al. | 417/180 |
| 3,732,851 | 5/1973 | Self | 122/487 |
| 3,774,846 | 11/1973 | Schung et al. | 239/102 |
| 4,071,586 | 1/1978 | Seger | 261/62 |
| 4,073,832 | 2/1978 | McGann | 261/118 |
| 4,278,619 | 7/1981 | Tiefenthaler | 261/62 |
| 4,284,590 | 8/1981 | DeBoer, Jr. | 261/118 |
| 4,474,477 | 10/1984 | Smith et al. | 261/118 |
| 4,514,196 | 4/1985 | Herrlander | 261/118 |
| 4,761,077 | 8/1988 | Werner | 261/118 |
| 4,909,445 | 3/1990 | Schoonover | 239/463 |

OTHER PUBLICATIONS

*Division Fl,* 1,208,588 Injectors, Dec. 19, 1967 pp. 154–155.

*Blakeborough Control Valves,* Catalog "Desuperheaters," Publication No. 388A.

Yarway, Catalog, "Steam Form Conditioning Valves: 84000 Series," 1989.

Yarway, Paper, "Advanced Valve Designs," by Max Kueffer, 1990.

*Primary Examiner*—Tim Miles

*Attorney, Agent, or Firm*—Lahive & Cockfield

[57] ABSTRACT

A spaced apart pair of plates in a steam bypass conduit provide pressure reduction and desuperheating of the steam. The plates have holes, some of which are equipped with nozzles that discharge water axially at the nozzle exits or radially at the throats. The nozzles are formed by inserts that form annular spaces communicating with a network of water supply conduits in the plate. Water discharge jets communicate with the annular spaces.

6 Claims, 3 Drawing Sheets

FIG. 4
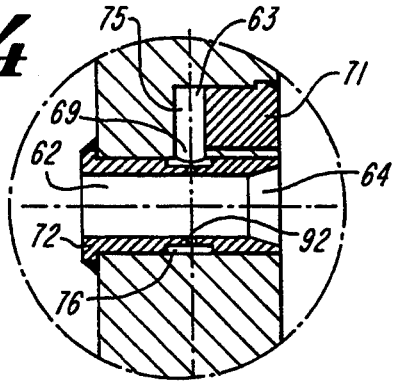
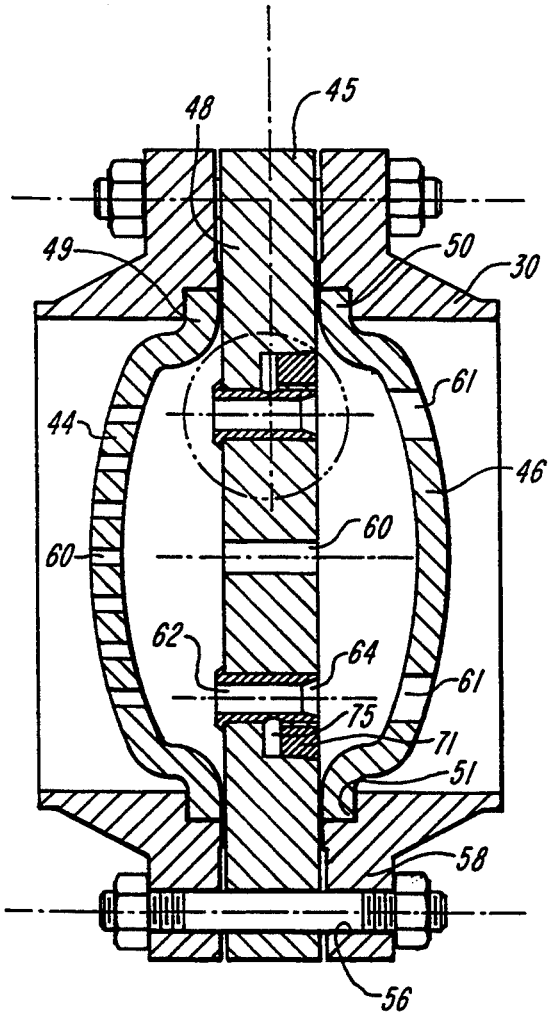
FIG. 2
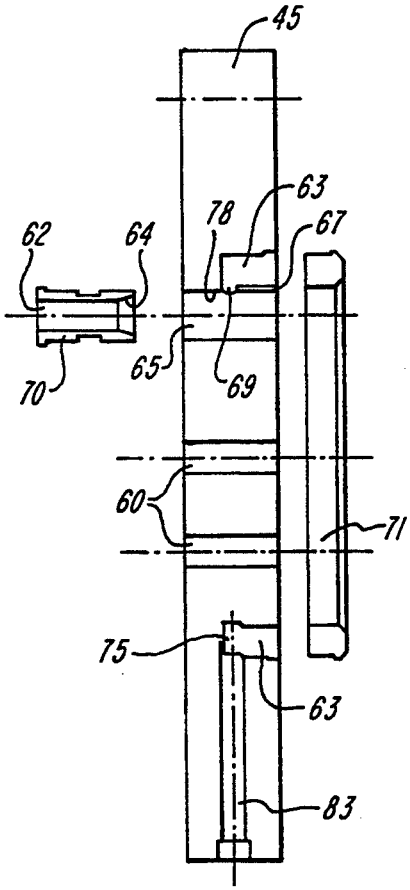
FIG. 5

PLATE TYPE PRESSURE-REDUCTING DESUPERHEATER

BACKGROUND OF THE INVENTION

This invention relates to the desuperheating of a gas by injection of its liquid phase from multiple locations in a plate type of desuperheater.

The most common application is water injection into steam, which is used hereafter only for illustration. Generally, the purpose of steam conditioning is to produce steam that is conditioned, or desuperheated, to a level that allows the steam to be used in a process requiring steam of a particular pressure or temperature, or that allows the steam to bypass the system process, for example.

There are many devices that have been developed to condition steam, based on the concepts of reducing pressure by restricting the passage of steam, and reducing steam enthalpy by introducing water into the steam flow. In some cases the functions have been combined in a single device, such as that shown in U.S. Pat. No. 2,725,221, where a pressure-reducing valve includes means for injecting cooling water into the hot steam in the valve.

There is continuing need for pressure reducing desuperheating devices that are simple and inexpensive to manufacture and operate, and that perform efficiently and reliably. This invention provides such a device.

SUMMARY OF THE INVENTION

The invention provides a pressure reducing desuperheating device for use in a gas conduit, having a plate baffle with a plurality of Venturi passages through the plate, the Venturi passages having axes parallel to the flow of gas, that has liquid discharge means in at least some of the Venturi passages for discharging the liquid phase of the line fluid at the Venturi passages to mix with the gas and that has liquid passage conduits in the plate for communicating between the liquid discharge means and a source of the liquid.

Preferably, the device includes a second downstream plate, spaced apart from the first, with passages co-axially aligned with the passages in the first plate. The passages in the second plate would be, preferably, approximately the same size as those in the first plate, and would be Venturi shaped, but would not have liquid discharge means. The first plate preferably also includes some passages without liquid discharge means, not Venturi shaped; the "wet" passages being more centrally located in the plate. The liquid passage conduit includes an annular groove in the first plate, with an annular ring sealingly occupying an upper portion of the groove, the bottom portion of the groove defining a conduit.

A third plate, with dry holes only, may be located upstream of the first two.

DESCRIPTION OF THE DRAWINGS

Other objects, features and advantages of the invention will be described in, or be readily apparent from, the following description of a preferred embodiment of the invention, including the drawings thereof, in which:

FIG. 2 is a cross-sectional view of the desuperheater installed in a steam pipe;

FIG. 4 is a detail of the cross-sectional view of FIG. 2;

FIG. 5 is a sectional view of the center plate of FIG. 3 along the line 5—5, showing components exploded for clarity.

BRIEF DESCRIPTION OF A PREFERRED EMBODIMENT

Figure 1:
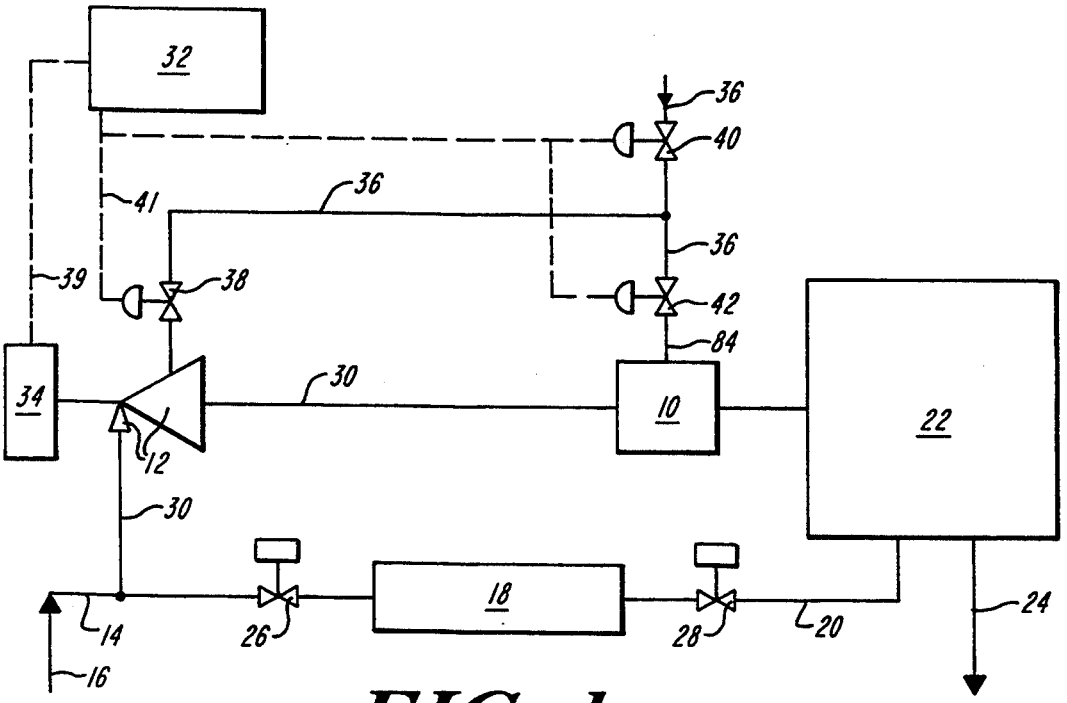
FIG. 1 is a diagrammatic representation of a typical process in which the desuperheater of the invention in utilized.

The system of FIG. 1 shows a desuperheater 10 used in a steam line as a secondary pressure reduction device following a primary controllable pressure reduction valve or pressure reduction desuperheater 12, although there may be cases where the device can be used alone.

A steam conduit 14 provides high pressure, high temperature steam (indicated by the arrow 16) from a boiler not shown. The steam conduit 14 leads to the major element of the process, in this case, a steam turbine 18. An outlet conduit 20 from the steam turbine 18 leads to a dump tank 22, where the spent steam is prepared for recirculation to the boiler by a recirculation conduit 24.

The system includes isolation valves 26, 28 on either side of the steam turbine 18 for isolating the turbine 18 from the process when necessary, such as when there is some failure in the process. A bypass conduit 30 is provided to take steam generated by the boiler and send it to the dump tank 22 when the isolation valves 26, 28 are operated.

A plant system controller 32 controls the operation of devices along the bypass conduit 30. One of the devices is the primary pressure reduction desuperheater 12, with a valve under the control of a valve control 34 and a water supply 36 under the control of a liquid flow valve 38. The valve control 34 and liquid flow valve 38 are under the control of the plant system controller 32, illustrated by control lines 39, 41. The water supply line 36 also supplies water to other liquid flow valves 40, 42, one of which, under the control of the plant system controller 32, supplies water to the pressure reducing desuperheater 10 of the invention, located after the primary device 12 in the steam bypass conduit 30 and before the dump tank 22.

The desuperheater 10 is used when the isolation valves 26, 28 are closed to bypass the stream turbine 18 in an emergency, so that part or all of the hot gas (steam) is sent to the bypass conduit 30 to be cooled, depressurized and discharged into the dump tank 22. The desuperheater 10 is installed, in this case, downstream of a primary pressure reducing desuperheater 12 and sized together with that device for the particular operation desired.

Figure 3:
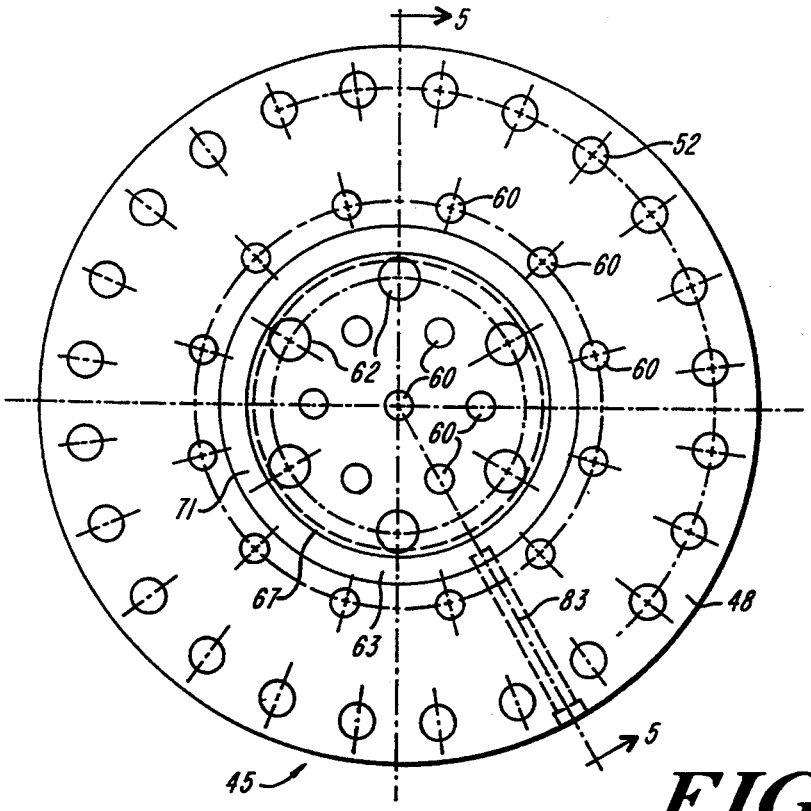
FIG. 3 is an axial view of the center plate of the desuperheater.

The pressure reducing plate desuperheater 10 of the invention is shown in greater detail in FIG. 2. It includes three plates 44, 45 and 46. The center plate 45 (see FIG. 3) has a periphery 48 with mounting holes 52 corresponding to holes 56 in the neck 58 of the steam bypass pipe 30. The outside plates 44, 46 have peripheries 49, 50 captured in recesses 51 in the neck 58 of the bypass pipe 30 may also have mounting holes corresponding to holes 56 in the neck. All the plates 44, 45 and 46 are mounted in the bypass pipe 30 to be perpendicular to the steam flow. The inlet plate 44 is a typical pressure reducing plate, while the center and outlet plates 45, 46 are integral parts of the desuperheater.

The plates are drilled for "dry" holes, or passages, 60, for "wet" holes, or passages, 62, or for holes for mixing-/evaporative purposes 61. That is, dry holes 60, found in the pressure reducing plate 44, simply allow steam to pass through, thereby providing a pipe wall insulating gas annulus as well as reducing the gas pressure. "Wet" holes, or passages, 62 (shown in detail in FIGS. 4 and 5) are located in the center plate 45. They have nozzles 64 that allow the injection of water into the path of steam passing through the passages. Finally, the last plate 46 has passages 61, coaxially aligned with the "wet" passages 62 of the center plate 45 that are about the same radial dimension as the "wet" passages 62. The passages 61 could be Venturi shaped, like the "wet" passages 62, but without any liquid discharge means.

The center plate 45 is slightly dished after drilling to assure that thermal flexure is directionally biased toward the hot side, thereby limiting thermal stress.

The wet holes 62 and their immediate water supply are constructed as follows. An annular groove 63 is machined in the center plate 45 (see FIG. 5). Holes 65 are drilled through the center plate 45 just inside the inner edge of the annular groove 63 so that a wall 67 remains between the holes 65 and the groove 63. A radial conduit 69 results from the radial undercut of groove 63 through the wall 67 to connect the groove 63 to the hole 65. An annular ring 71 is seal welded into the upper portion of the groove 63, leaving the unoccupied lower portion as a conduit 75. The nozzles 64 of the center plate 45 are formed from nozzle inserts 70 inserted into the holes 65 drilled through the center plate 45 (see FIGS. 4 and 5). A nozzle insert 70 (see FIG. 6A) includes a head 72 on the gas inlet side to prevent displacement, and an outside annular groove 74 to provide an annular space 76 between the nozzle insert 70 and the wall 78 of the plate hole 65. The wall 78 adjacent the groove 74 has radial conduit 69 communicating with the annular conduit 75 in the plate 45. The annular conduit 75 communicates, finally, with a conduit 83 fed by a water pipe bringing water to the plate 45. The water pipe is controlled by the valve 42 responsive to the plant system controller 32.

The nozzle insert 70 has an interior of the usual Venturi configuration with rounded inlet and beveled outlet.

Figure 6A:
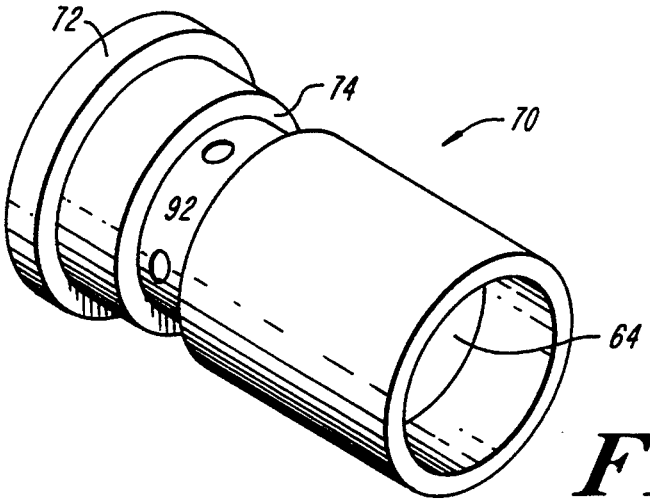
FIGS. 6A, 6B and 6C illustrate, in perspective views, three variations of inserts that are used in the desuperheater.

The nozzle insert 70 includes a plurality of narrow radial conduits 92 perpendicular to the axis of the nozzle 64, leading from the annular space 76 to the interior of the nozzle 64 (see FIG. 6A).

Figure 6B:
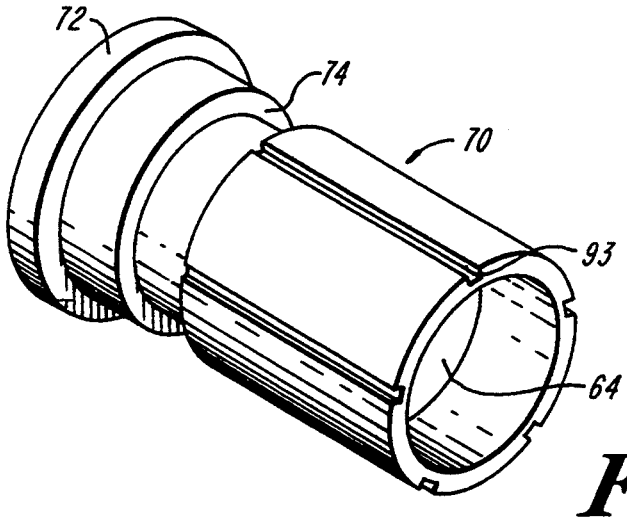
Figure 6C:
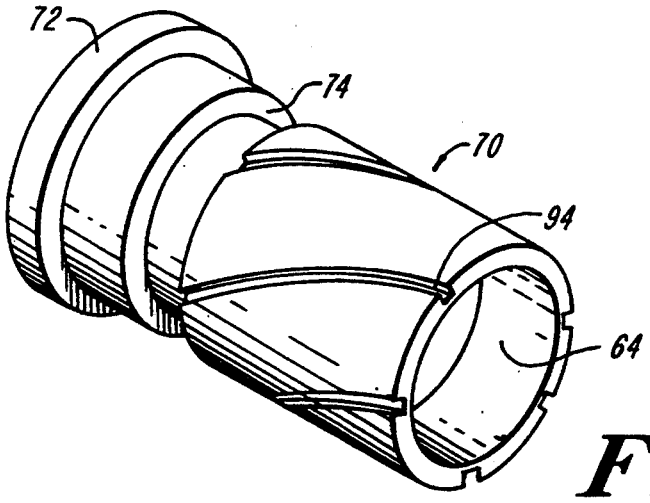

In an alternative embodiment of the nozzle inserts 70 (see FIG. 6B), water is discharged along axial channels 93, axially, where turbulence is greatest. Alternatively, the channels 94 can be oriented in a spiral manner imparting additional turbulence to the injected liquid and enhancing the evaporation process (see FIG. 6C). The amount of liquid injected is controlled by the externally mounted valve 42, typically controlled by a temperature or flow signal from the process fluid.

The plate 45 allows construction of an annular conduit distribution header, while the nozzles permit the accurate location of a multitude of liquid jets near the piping center. An outer ring of gas-only holes 60 (see FIG. 3) permits the piping wall 30 to be protected from the deleterious effects of liquid impact, since the liquid-gas mixture can be kept near the piping centerline.

The number of plates is dictated by the application and the appropriate fluid properties. Liquid injected at the center or "wet" plate 45 in either radial, axial or spiral fashion is further mixed and expanded in the matching holes in the outlet plate 46. By aligning the sets of "wet" holes 62 in the center plate 45 with mixing holes 61 in the outlet plate 46 a jet pump effect can be achieved. The drop in pressure through the outlet plate 46 will promote rapid explosive drop evaporation so that shortening the pipeline mixing length is achieved. The maximum number of plates is not limited, but should preferably be no more than four.

The number and location of nozzles 64 in the plates may be varied to suit flow rate, pressure drop across the plate, bolt pattern and available space. In most cases, the nozzles 64 will be in the second from outer ring of holes in the plate 45.

Other variations and modifications of the preferred embodiment may occur to those skilled in the art, but would be considered to come within the spirit and scope of the invention, as defined in the following claims.

What is claimed is:

1. A pressure reducing and desuperheating device for use in a stream or gas conduit, comprising:

at least a first plate baffle, said first plate baffle defining a plurality of Venturi passages through said first plate baffle, said passages having axes parallel to the flow of steam or gas in said conduit, said first plate baffle further including liquid discharge means located in at least some of said passages for discharging liquid at said passages to mix with the steam or gas passing through said passages, and liquid passage conduits defined by said first plate baffle for communicating between said liquid discharge means and a liquid source further including a second plate baffle, downstream from said first plate baffle and spaced apart form said first plate baffle, said second plate baffle defining a plurality of second passages through said second plate baffle, said second passages arranged coaxially with at least some of said Venturi passages in said first plate baffle.

2. The device of claim 1 in which said second passages have an opening of approximately the same size as the openings of said Venturi passages.

3. The device of claim 1 in which said second passages are also Venturi shaped.

4. A pressure reducing and desuperheating device for use in a steam or gas conduit, comprising:

at least a first plate baffle;

said first plate baffle defining a plurality of Venturi passages through said first plate baffle, said passages having axes parallel to the flow of steam or gas in said conduit, said first plate baffle further including liquid discharge means located in at least some of said passages for discharging liquid at said passages to mix with the steam or gas passing through said passages, and liquid passage conduits defined by said first plate baffle of communicating between said liquid discharge means and a liquid source wherein said liquid passage conduits include an annular groove in said plate, and an annular cap sealingly occupying an upper portion of said groove, the unoccupied lower portion of said annular groove defining a conduit.

5. A pressure reducing and desuperheating device for use in a steam or gas conduit, comprising:

at least a first plate baffle, said first plate baffle defining a plurality of Venturi passages through said first plate baffle, said passages having axes parallel to the flow of steam or gas in said conduit, said first plate baffle further including liquid discharge means located in at least some of said passages for discharging liquid at said passages to mix with the steam or gas passing through said passages, and liquid passage conduits defined by said first plate baffle for communicating between said liquid discharge means and a liquid source wherein said first plate baffle further defines third cylindrical passages through said first plate baffle, said third cylindrical passages being located outwardly of said Venturi passages.

6. A pressure reducing desuperheating device for use in a steam or gas conduit, comprising:

a plate baffle, said plate baffle defining a plurality of holes through said plate baffle, said plate baffle defining an annular groove, and an annular cap sealingly occupying an upper portion of said groove, the unoccupied lower portion of said annular groove defining a liquid passage conduit, said plate baffle further defining passages between said liquid passage conduit and said holes, and a plurality of Venturi shaped annular inserts, insertable in said holes, said inserts defining liquid passages communicating with said liquid passage conduits, said liquid passages defining liquid discharge means for discharging liquid at said inserts to mix with steam or gas passing through said inserts.

* * * * *